US010739012B2

(12) United States Patent
Park et al.

(10) Patent No.: US 10,739,012 B2
(45) Date of Patent: Aug. 11, 2020

(54) HOME APPLIANCE

(71) Applicant: Samsung Electronics Co., Ltd., Suwon-si (KR)

(72) Inventors: Seong Hwan Park, Suwon-si (KR); Duk Yong Park, Hwaseong-si (KR); Chun Bae Lee, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 405 days.

(21) Appl. No.: 15/693,878

(22) Filed: Sep. 1, 2017

(65) Prior Publication Data

US 2018/0066849 A1 Mar. 8, 2018

(30) Foreign Application Priority Data

Sep. 8, 2016 (KR) ..... 10-2016-0115385

(51) Int. Cl.
*F24C 7/08* (2006.01)

(52) U.S. Cl.
CPC ..... *F24C 7/086* (2013.01); *F24C 7/082* (2013.01); *F24C 7/08* (2013.01); *F24C 7/085* (2013.01)

(58) Field of Classification Search
None
See application file for complete search history.

(56) References Cited

U.S. PATENT DOCUMENTS 4,605,828 A * 8/1986 Gostomski, Jr. ..... H01H 13/702 200/5 A
6,127,640 A 10/2000 Pan et al.
6,881,935 B2 * 4/2005 Kim ..... F24C 7/082 219/702
2004/0144775 A1 7/2004 Kim et al.
2007/0046874 A1 * 3/2007 Adachi ..... G02F 1/133308 349/122
2008/0081197 A1 4/2008 Huang
2009/0102808 A1 * 4/2009 Huang ..... G06F 3/041 345/173
2009/0142533 A1 6/2009 Cheng
2012/0285811 A1 11/2012 Chiba et al.
(Continued)

FOREIGN PATENT DOCUMENTS

JP 2002-109491 4/2002
JP 4406594 B2 * 1/2010
JP 2010204376 A * 9/2010
(Continued)

OTHER PUBLICATIONS

JP2006107938(A), Apr. 2006, "Press Sensor," Kanao et al, published application for JP4406594(B2) listed on PTO-892 (Year: 2006).*

(Continued)

*Primary Examiner* — Joseph M Pelham
(74) *Attorney, Agent, or Firm* — Staas & Halsey LLP

(57) ABSTRACT

A home appliance includes a control panel for operating the home appliance. The control panel may include a membrane panel and a base to which the membrane panel is attached. When the membrane panel is attached to the base, a plurality of protrusions or a plurality of recesses may be formed in an adhering portion of the base so that no air bubbles remain between the membrane panel and the base.

18 Claims, 10 Drawing Sheets

(56) References Cited

U.S. PATENT DOCUMENTS

2018/0063962 A1* 3/2018 Lee ..... G06F 3/041

FOREIGN PATENT DOCUMENTS

| | | |
|---|---|---|
| KR | 10-1999-0032459 | 5/1999 |
| KR | 10-2003-0056959 | 7/2003 |
| KR | 10-2004-0047085 | 6/2004 |
| KR | 10-2004-0067641 | 7/2004 |
| KR | 10-2015-0004189 | 1/2015 |

OTHER PUBLICATIONS

International Search Report dated Dec. 19, 2017 in International Patent Application No. PCT/KR2017/009640.

* cited by examiner

HOME APPLIANCE

CROSS-REFERENCE TO RELATED APPLICATIONS

This application claims the benefit of Korean Patent Application No. 10-2016-0115385, filed on Sep. 8, 2016 in the Korean Intellectual Property Office, the disclosure of which is incorporated herein by reference.

BACKGROUND

1. Field

Embodiments of the present disclosure relate to a home appliance including a membrane panel, and more particularly, to a home appliance including a structure that prevents air bubbles from remaining on the back side of the membrane panel when the membrane panel is attached.

2. Description of the Related Art

Generally, home appliances may include various types such as an oven, a refrigerator, and an air conditioner, and a home appliance may include a control panel for controlling operations.

For example, the oven has a cabinet-shaped main body, a cooking compartment provided inside the main body, and a cooktop for heating a container placed thereon and containing food may be provided on the upper portion of the main body. Electricity or gas may be used as an energy source for heating the food.

The main body of the home appliance may be provided with a device for operating the home appliance. The operating device may be provided in various forms such as a control panel, a dial knob, a button, etc., which allow a user to set an operation mode desired by the user or to set various conditions necessary for the operation. In addition, the control panel may be provided in a membrane panel type or a touch panel type.

SUMMARY

Therefore, it is an aspect of the present disclosure to provide a home appliance including a plurality of protrusions or a plurality of recesses in an adhering portion of a main body for attaching a membrane panel so that no bubbles remain on the back side of the membrane panel when the membrane panel is attached.

It is another aspect of the present disclosure to provide a home appliance including a structure in which no bubbles remain on the back side of a membrane panel and foreign substances such as water do not infiltrate from the outside.

Additional aspects of the disclosure will be set forth in part in the description which follows and, in part, will be obvious from the description, or may be learned by practice of the disclosure.

In accordance with an aspect of the present disclosure, there is provided a home appliance including: a membrane panel; a base having an adhering portion to which the membrane panel is adhered; and a plurality of protrusions provided at the adhering portion of the base and having a flat surface.

The membrane panel may include an adhesive layer on a back surface of the membrane panel.

The adhesive layer may be provided on the flat surface.

The plurality of protrusions may be formed integrally with the base. The base and the plurality of protrusions may be formed by pressing a plate material.

The plurality of protrusions may be formed integrally with the base. The base and the plurality of protrusions may be formed by injection molding.

The plurality of protrusions may have a height of 0.06 mm or more and 0.09 mm or less.

The plurality of protrusions may have a height of 0.08 mm.

The sum of the areas of the flat surfaces of the plurality of protrusions may be 40% or more and 70% or less of the area of the adhering portion of the base.

The sum of the areas of the flat surfaces of the plurality of protrusions may be 60% of the area of the adhering portion of the base.

The plurality of protrusions may include straight shaped protrusions arranged in parallel to each other, curved shaped protrusions arranged in parallel to each other, and dotted shaped protrusions arranged regularly.

The width or diameter of the flat surface of the plurality of protrusions may be no less than 10 times and no more than 18 times the height of the plurality of protrusions.

The distance between the flat surfaces of the adjacent two protrusions among the plurality of protrusions may be 0.6 mm or more and 1.2 mm or less.

In accordance with an aspect of the present disclosure, there is provided a home appliance including: a membrane panel; a base having an adhering portion to which the membrane panel is adhered; and a plurality of recesses provided at the adhering portion of the base.

The base and the plurality of recesses may be formed by pressing or etching a plate material.

The base and the plurality of recesses may be formed by injection molding.

The plurality of recess may have a depth of 0.06 mm or more and 0.09 mm or less. The sum of the areas where the recesses may be formed is 30% or more and 60% or less of the area of the adhering portion of the base.

The plurality of recesses may include at least one of a straight, curved, and dotted shape.

The distance between two adjacent recesses among the plurality of recesses may be no less than 10 times and no more than 18 times the depth of the plurality of recesses.

The diameter or width of the plurality of recesses may be 0.6 mm or more and 1.2 mm or less.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
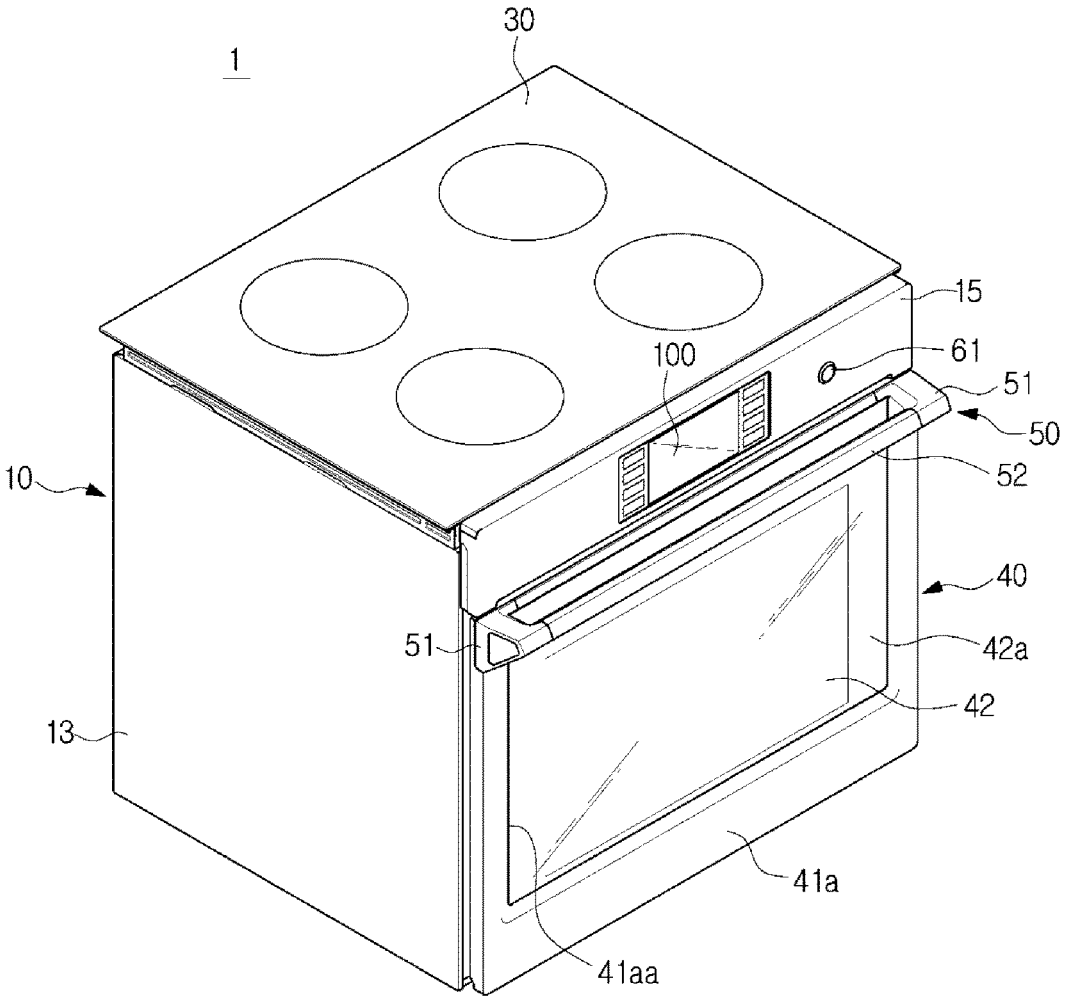
FIG. 1 is a perspective view of an oven according to an embodiment of the present disclosure.

Configurations illustrated in the embodiments and the drawings described in the present specification are only the preferred embodiments of the present disclosure, and thus it is to be understood that various modified examples, which may replace the embodiments and the drawings described in the present specification, are possible when filing the present application.

Like reference numerals or symbols used in the drawings of the present specification represent members or components performing substantially the same functions.

The terms used in the present specification are used to describe the embodiments of the present disclosure. Accordingly, it should be apparent to those skilled in the art that the following description of exemplary embodiments is provided for illustrative purposes only and not for the purpose of limiting the embodiments as defined by the appended claims and their equivalents. It is to be understood that the singular forms "a," "an," and "the" include plural referents unless the context clearly dictates otherwise. In this specification, it will be understood that when the terms "includes," "comprises," "including," and/or "comprising" are used in this specification, they specify the presence of stated features, figures, steps, components, or combinations thereof, but do not preclude the presence or addition of one or more other features, figures, steps, components, members, or combinations thereof.

It will be understood that, although the terms first, second, etc. may be used herein to describe various components, these components should not be limited by these terms. These terms are only used to distinguish one component from another. For example, a first component could be termed a second component, and, similarly, a second component could be termed a first component, without departing from the scope of the present disclosure. As used herein, the term "and/or" includes any and all combinations of one or more of the associated listed items.

Hereinafter, an oven according to an embodiment of a home appliance according to the present disclosure will be described in detail with reference to the accompanying drawings.

Hereinafter, the front surface and the forward direction are referred to as the front surface and the forward direction of an oven 1 shown in FIG. 1, and the rearward direction refers to the rearward direction of the oven 1.

Figure 2:
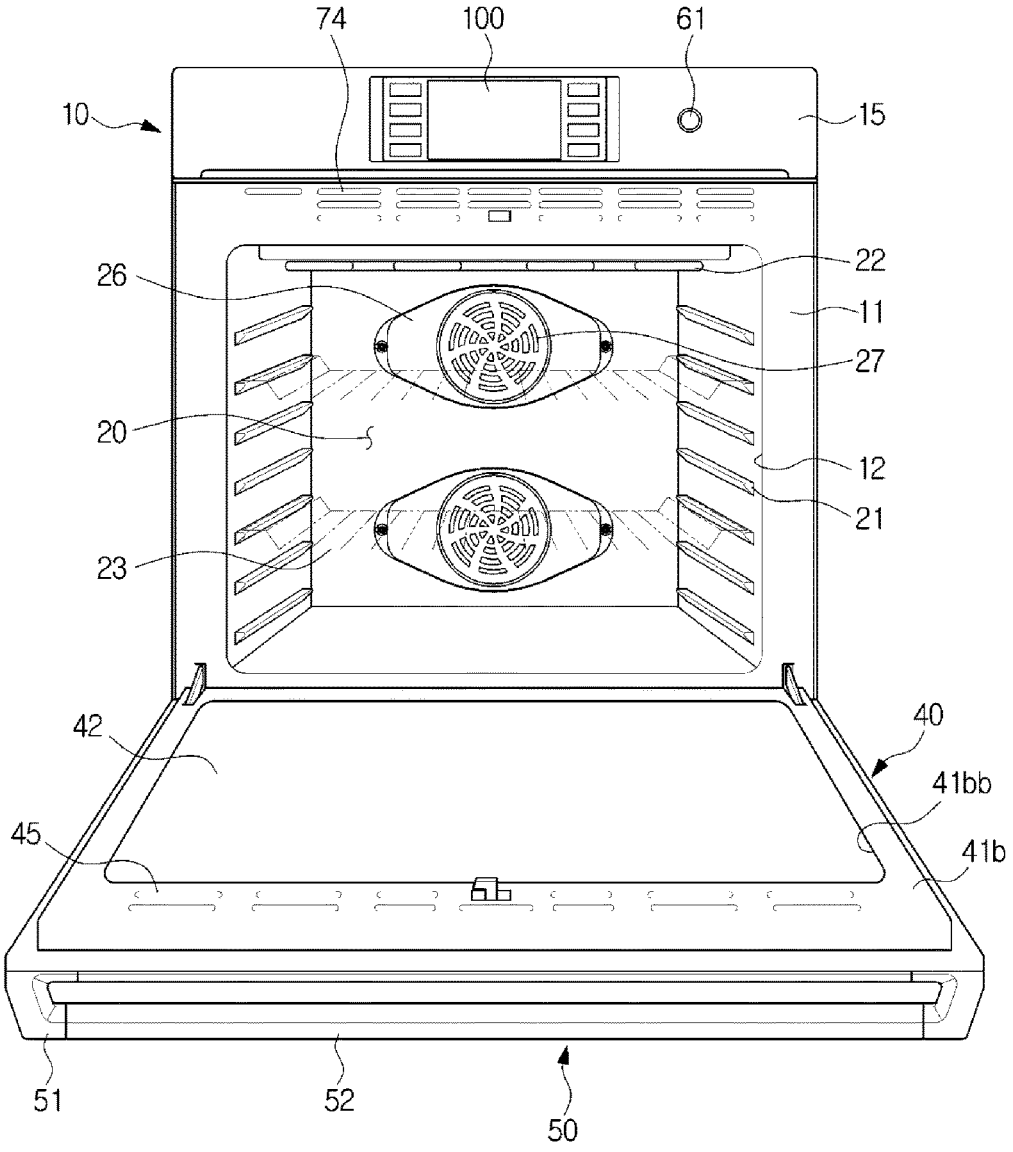
FIG. 2 is a view illustrating a door of an oven opened according to an embodiment of the present disclosure.
Figure 3:
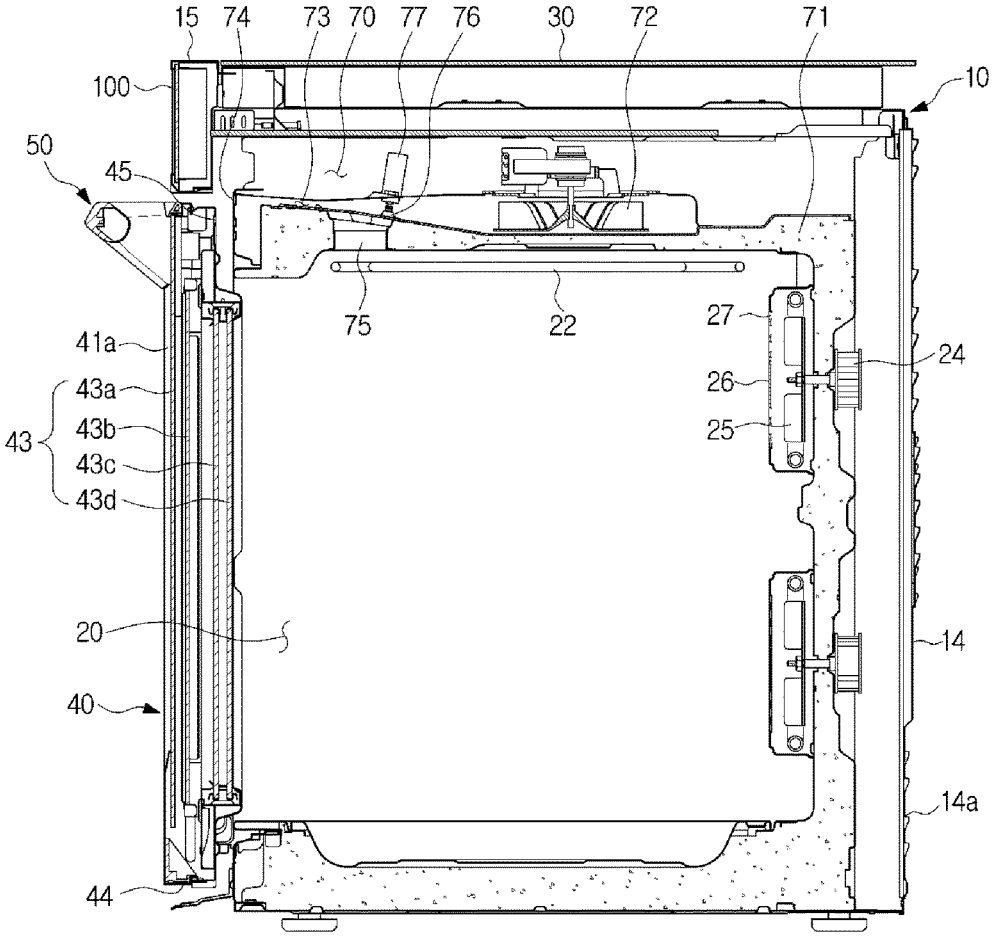
FIG. 3 is a side cross-sectional view of an oven according to an embodiment of the present disclosure.

FIG. 1 is a perspective view of an oven according to an embodiment of the present disclosure, FIG. 2 is a view illustrating a door of an oven opened according to an embodiment of the present disclosure, and FIG. 3 is a side cross-sectional view of an oven according to an embodiment of the present disclosure.

The oven 1 includes a main body 10 having a cooking compartment 20 located inside and a cooktop 30 provided at an upper end of the main body 10 and may heat a container disposed on the cooktop.

The main body 10 includes a front panel 11 forming a front surface of the main body 10, a side panel 13 forming a side surface of the main body 10, and a back panel 14 forming a rear surface of the main body 10.

The cooking compartment 20 is provided inside the main body 10 in a box shape, and the front surface thereof may be opened so that food may be put into and taken out. The front panel 11 may be provided with an opening 12 corresponding to the cooking compartment 20 having an open front. The open front of the cooking compartment 20 may be opened and closed by a door 40.

A plurality of supports 21 may be provided inside the cooking compartment 20. A plurality of racks 23 for placing food may be mounted on the plurality of supports 21. The plurality of supports 21 may be provided to protrude from the left and right walls of the cooking compartment 20.

A divider (not shown) for dividing the cooking compartment 20 may be detachably mounted on the plurality of supports 21. Specifically, the divider (not shown) may be mounted horizontally in the cooking compartment 20 to divide the cooking compartment 20 into a plurality of chambers.

The plurality of cooking compartments 20 need not have the same size, but may have different sizes. The divider (not shown) may have an insulating material and may insulate each cooking compartment 20. Thus, the cooking compartment 20 may be utilized in various ways according to the user's intention.

The cooking compartment 20 may be provided with a heater 22 for heating food. In this embodiment, the heater 22 may be an electric heater including an electric resistor. However, unlike in this embodiment, the heater 22 may be a gas heater that generates heat by burning gas. That is, the oven 1 according to the embodiment of the present disclosure includes an electric oven and a gas oven.

A circulation fan 25 for circulating air in the cooking compartment 20 to heat the food evenly is provided at the rear of the cooking compartment 20 and a circulation motor 24 for driving the circulation fan 25 is provided at the rear of the cooking compartment 20. A fan cover 26 covering the circulation fan 25 may be provided in front of the circulation fan 25. A through hole 27 may be formed in the fan cover 26 to allow air to flow.

The door 40 may be hinged to the lower side of the main body 10 so as to be rotatable with respect to the main body 10 to open and close the cooking compartment 20. Alternatively, although not shown, the door 40 may be hinged to the left or right of the main body 10.

The door 40 may include a window 42 so that the cooking process inside the cooking compartment 20 may be externally confirmed. Specifically, the door 40 may include a door frame having an opening to provide a view of inside the cooking compartment 20 from outside of the cooking compartment, and the door frame may include a front frame 41*a* and a rear frame 41*b*. The front frame 41*a* may include a front frame opening 41*aa* for providing the window 42 and the rear frame 41*b* may include a rear frame opening 41*bb*.

The door 40 may be provided with a plurality of panels 43 for heat insulation inside the cooking compartment 20. The plurality of panels 43 is made of a transparent material such as glass to form the window 42 so that the inside of the cooking compartment 20 may be seen. Accordingly, the plurality of panels 43 may be formed of a transparent member other than glass.

The plurality of panels 43 may include a first panel 43*a*, a second panel 43*b*, a third panel 43*c*, and a fourth panel 43*d* arranged in the forward and rearward directions. A masking portion 42*a* may be provided on a part of the first panel 43*a* disposed at the frontmost position. The masking portion 42*a* covers the structure inside the door 40 and prevents the light illuminating the inside of the cooking compartment 20 from being reflected on the structure inside the door 40 and leaking out. Specifically, the masking portion 42*a* may be provided on the back side of the first panel 43*a* so as to surround the central portion forming the window 42. The masking portion 42*a* may be formed on the back surface of the first panel 43*a* by a printing method or the like.

At the lower end of the door 40, a door suction port 44 for sucking air into the inside of the door 40 may be provided. The outside air introduced from the lower end of the door 40 is heat exchanged with the heat transferred from the cooking compartment 20 while moving to the upper side of the door 40 and then may be discharged through a door discharge port 45 provided in the rear frame 41*b* located at the rear of the door 40. With this arrangement, the oven according to the present disclosure can cool the heat inside the door 40 through the circulation of air.

A handle 50, which can be gripped by the user, may be provided at the upper end of the front surface of the door 40 to easily open and close the door 40. When the door 40 is hinged to the left or right of the main body 10, the handle 50 may correspondingly be provided on the right or left side of the front surface of the door 40.

The handle 50 may protrude forward by a predetermined length from the front surface of the door 40. The handle 50 may include a pair of handle supports 51 extending forward from the front surface of the door 40 and a handle extension 52 connecting the pair of handle supports 51.

A button 61 for operating the oven 1 and a control panel 100 to display various kinds of operation information of the oven 1 and to input an operation command by the user may be provided on the front of the front panel 11. The control panel 100 and the button 61 may be mounted on an electronic component chamber cover 15. In the present embodiment, the control panel 100 is disposed on the upper portion of the front surface of the main body 10, but the present disclosure is not limited thereto.

The oven 1 has an electronic component chamber 70 for receiving electronic components that control the operation of various parts. The electronic component chamber 70 is provided at an upper side of the cooking compartment 20. A heat insulating material 71 for insulating the electronic component chamber 70 and the cooking compartment 20 may be provided between the electronic component chamber 70 and the cooking compartment 20. The heat insulating material 71 prevents the heat of the cooking compartment 20 from being transmitted to the electronic component chamber 70.

The heat insulating material 71 may entirely cover the outside of the cooking compartment 20 so that the heat of the cooking compartment 20 is not transmitted to the outside of the oven as well as the electronic component chamber 70 and the cooking compartment 20.

The oven 1 has a cooling structure for cooling the electronic component chamber 70 by circulating air around the cooking compartment 20. The cooling structure of the oven 1 may include a cooling fan unit 72 for flowing air and a cooling passage 73 for discharging the air sucked by the cooling fan unit 72 to the front of the oven 1.

The air outside the main body is sucked into the electronic component chamber 70 through a through hole 14*a* formed in the back panel 14 and the air sucked into the electronic component chamber 70 flows inside the electronic component chamber 70 and cools the electronic components, and then the air may be finally discharged to the front of the oven 1 through a discharge port 74 along the cooling passage 73.

A portion of the air in the cooking compartment 20 can be sucked to the cooling passage 73 side through an exhaust passage 75 and discharged to the front of the oven 1. A bypass hole 76 for introducing a part of the air flowing from the cooling passage 73 to the discharge port 74 into the exhaust passage 75 may be additionally formed. The bypass hole 76 is opened and closed by an opening and closing device 77 and the amount of exhaust of the air of the cooking compartment 20 which is discharged to the cooling passage 73 may be adjusted in accordance with the opening and closing of the bypass hole 76.

Hereinafter, the control panel 100 for operating the oven 1 according to one embodiment of the present disclosure will be described in detail.

Figure 4:
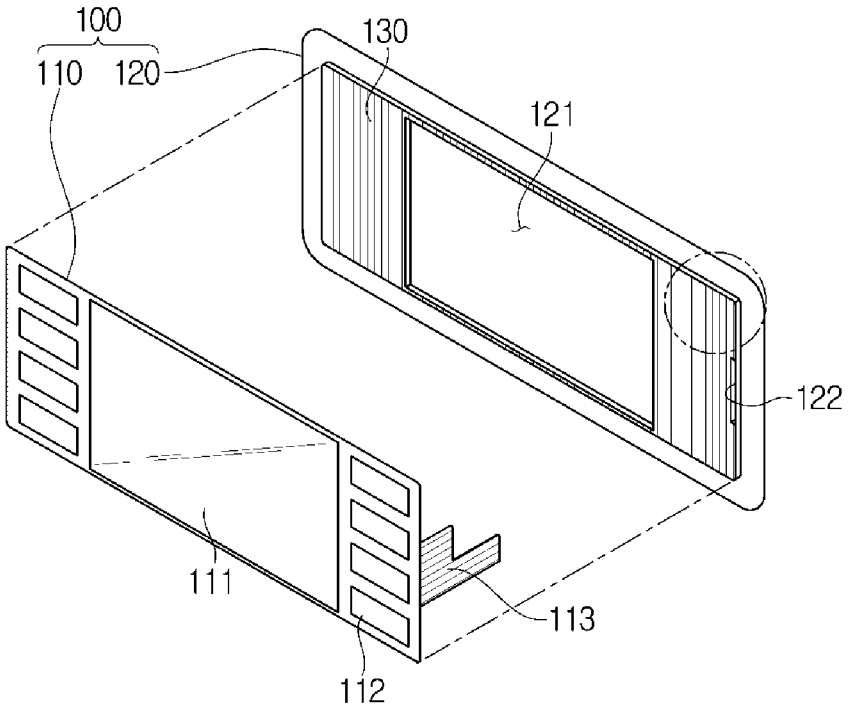
FIG. 4 is an exploded perspective view of a control panel of an oven according to an embodiment of the present disclosure.
Figure 5:
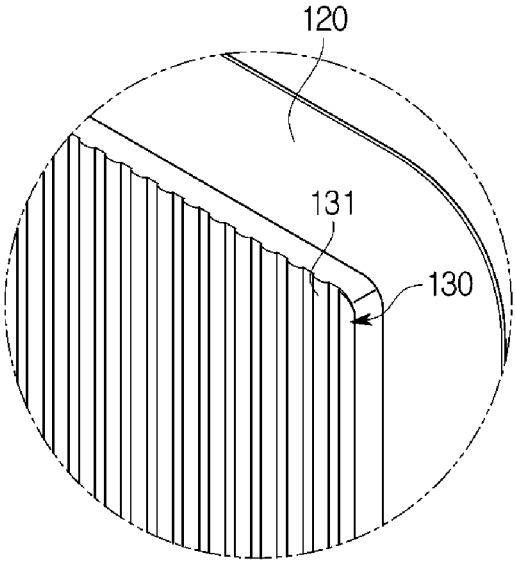
FIG. 5 is an enlarged perspective view of a part of a base of a control panel of an oven according to an embodiment of the present disclosure.
Figure 6:
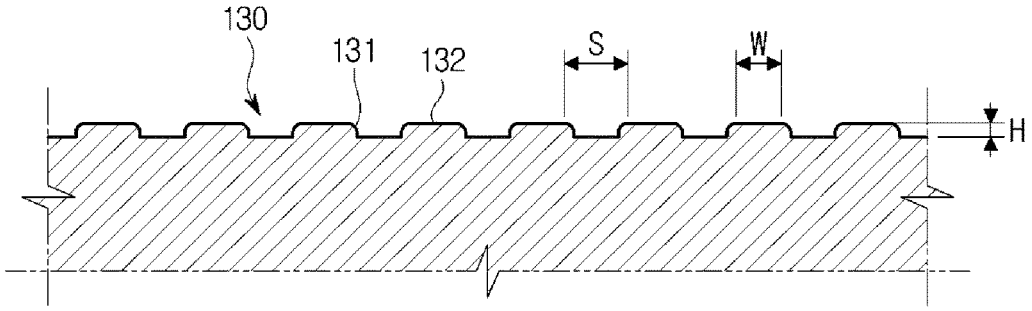
FIG. 6 is an enlarged cross-sectional view of a part of a base of a control panel of an oven according to an embodiment of the present disclosure.

FIG. 4 is an exploded perspective view of a control panel of an oven according to an embodiment of the present disclosure, FIG. 5 is an enlarged perspective view of a part of a base of a control panel of an oven according to an embodiment of the present disclosure, and FIG. 6 is an enlarged cross-sectional view of a part of a base of a control panel of an oven according to an embodiment of the present disclosure.

Referring to FIGS. 4 to 6, the control panel 100 may include a membrane panel 110 and a base 120 to which the membrane panel 110 is attached. The membrane panel 110 may include a display portion 111 and an operating portion 112.

In this embodiment, the base 120 providing the adhering portion of the membrane panel 110 is illustrated as being removable from the main body 10, but the spirit of the present disclosure is not limited thereto. For example, the base 120 may be formed integrally with the main body 10 of the oven 1.

The membrane panel 110 may include the operating portion 112 in which letters and symbols representing functions to be performed such as the type of food and cooking time are printed and the display portion 111 for displaying the cooking time, the type of cooking, or the process of cooking in order to inform the user about the operation state information of the oven 1.

The display portion 111 of the membrane panel 110 may be transparent so as to expose the display panel or the touch panel provided at the rear side of the base 120 and the base 120 may be provided with an opening 121 at a portion corresponding to the display portion 111 of the membrane panel 110.

Although not shown in the figures, the membrane panel 110 may include therein a circuit structure for sensing the input of the operating portion 112. The circuit structure may be provided in the form of a flexible circuit board 113 or the like. The flexible circuit board 113 may protrude from one side of the membrane panel 110 and may pass through a through hole 122 of the base 120 and may be connected to the inside of the electronic component chamber 70.

The membrane panel 110 may be attached to the front surface of the base 120 through a conventional double-sided adhesive tape or an adhesive. When the air is introduced into the adhesive surface in the process of attaching the membrane panel 110 to the base 120, the bubbles are left on the adhesive surface so that the membrane panel 110 is lifted or swollen. As a result, apparent bending is caused deteriorating the quality of the appearance, and these residual bubbles may cause a malfunction by pressing the circuit structure inside the membrane panel 110.

Conventionally, in order to remove such residual bubbles, special equipment or tools for pressing the membrane panel 110 or special equipment or tools have been required to attach the membrane panel 110 in a vacuum state.

The control panel 100 according to the present disclosure may include a plurality of protrusions 131 provided at an adhering portion of the base 120 to which the membrane panel 110 is attached so that the membrane panel 110 may be attached without generating any residual bubbles, without using any special equipment or tools.

Referring to FIG. 6, the protrusion 131 may have a flat surface 132 at the top. The membrane panel 110 may be attached to the flat surface 132. The membrane panel 110 may include an adhesive layer (not shown) formed on the rear surface thereof with an adhesive tape or an adhesive. In addition, an adhesive layer may be provided on an adhering portion 130 of the base 120 to which the membrane panel 110 is attached. In particular, an adhesive layer may be provided on the flat surface 132 provided at the top of the protrusion 131.

The plurality of protrusions 131 may be integrally formed with the base 120. The plurality of protrusions 131 may be formed with the base 120 by pressing a plate material such as an iron plate. In addition, the base and the plurality of protrusions 131 may be formed by injection molding a metal or a resin material. The protrusion 131 may be formed by corroding the portion of the base 120 except for the portion where the protrusion 131 is formed. Also, the plurality of protrusions 131 may be separately manufactured and attached to the base 120.

It is preferable that the sum of the areas of the flat surfaces 132 of the plurality of protrusions 131 is equal to or more than 40% of the area of the adhering portion of the base 120 in order to secure a certain level of adhesion. However, it is preferable that the sum of the areas of the flat surfaces 132 of the plurality of protrusions 131 is 70% or less of the area of the adhering portion of the base 120 in order to suppress the generation of the residual bubbles. More preferably, the sum of the areas of the flat surfaces 132 of the plurality of protrusions 131 may be 60% of the area of the adhering portion of the base 120.

A height H of the protrusion 131 provided on the base 120 may vary depending on the forming method, but it may be generally 0.06 mm or more. If the height of the protrusion 131 is excessively high, there is a possibility that water or foreign matter may permeate between the protrusions, that is, between the membrane panel 110 and the base 120. Therefore, the height H of the protrusion 131 may be 0.09 mm or less. More preferably, the height H of the protrusion 131 may be 0.08 mm. Tolerance may be accepted to 0.01 mm.

The height of the protrusion 131 may be lowered below the lower limit value according to the development of the manufacturing technology, and may be increased to an upper limit value or more when a material not susceptible to humidity is used for the membrane panel 110.

Figure 7:
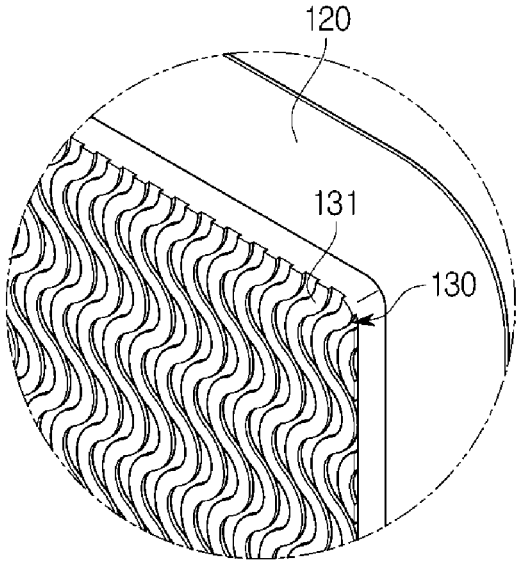
FIG. 7 is an enlarged perspective view of a part of a base of a control panel of an oven according to another embodiment of the present disclosure.

FIG. 7 is an enlarged perspective view of a part of a base of a control panel of an oven according to another embodiment of the present disclosure.

Referring to FIG. 5, the plurality of protrusions 131 may be formed in a straight shape, and referring to FIG. 7, the plurality of protrusions may be formed in a curved shape. The plurality of protrusions 131 formed in a linear shape may be arranged in parallel with each other, and may be arranged at regular intervals. However, the spirit of the present disclosure is not limited thereto, and the plurality of protrusions 131 may not be parallel to each other or may not be arranged with a constant interval.

According to the criteria of the straight shaped protrusion, it is preferable that the sum of the areas of the flat surfaces 132 of the plurality of curved shaped protrusions 131 is equal to or more than 40% and equal to or less than 70% of the area of the adhering portion of the base 120. More preferably, the sum of the areas of the flat surfaces 132 of the plurality of protrusions 131 may be 60% of the area of the adhering portion of the base 120. Further, the height H of the protrusion 131 is preferably 0.09 mm or less, and more preferably, the height H of the protrusion 131 may be 0.08 mm. Tolerance may be accepted to 0.01 mm.

In order to secure the flatness and adhesiveness of the base 120, the flat surface 132 at the top of the straight or curved shaped protrusion 131 may have a width W of 10 times or more and 18 times or less than the height H of the protrusion 131.

When the plurality of protrusions 131 are too close to each other, it is not easy to discharge the air between the membrane panel 110 and the base 120. When the plurality of protrusions 131 are too far from each other, there is a possibility that the membrane panel 110 is depressed and apparently curved. Therefore, it is preferable that a distance S between the flat surfaces 132 of two adjacent protrusions of the plurality of protrusions 131 is 0.6 mm or more and 1.2 mm or less. Tolerance may be accepted 0.1 mm.

Figure 8:
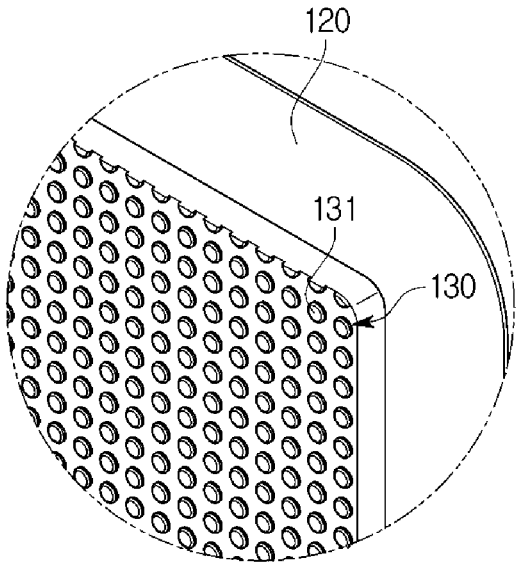
FIG. 8 is an enlarged perspective view of a part of a base of a control panel of an oven according to another embodiment of the present disclosure.

FIG. 8 is an enlarged perspective view of a part of a base of a control panel of an oven according to another embodiment of the present disclosure.

Referring to FIG. 8, a plurality of protrusions may be formed in a dotted shape. The plurality of protrusions 131 formed in a dotted shape may be regularly arranged in a triangular array or a rectangular array. However, the spirit of the present invention is not limited thereto, and a plurality of protrusions may be arranged to be irregularly distributed.

According to the criteria of the straight shaped and curved protrusion, it is preferable that the sum of the areas of the flat surfaces 132 of the plurality of dotted shaped protrusions is equal to or more than 40% and equal to or less than 70% of the area of the adhering portion of the base 120. More preferably, the sum of the areas of the flat surfaces 132 of the plurality of protrusions 131 may be 60% of the area of the adhering portion of the base 120. Further, the height H of the protrusion 131 is preferably 0.09 mm or less, and more preferably, the height H of the protrusion 131 may be 0.08 mm. Tolerance may be accepted to 0.01 mm.

In order to secure the flatness and adhesiveness of the base 120, the flat surface 132 at the top of the dotted shaped protrusion 131 may have the width W of 10 times or more and 18 times or less than the height H of protrusion 131.

When the plurality of protrusions 131 are too close to each other, it is not easy to discharge the air between the membrane panel 110 and the base 120. When the plurality of protrusions 131 are too far from each other, there is a possibility that the membrane panel 110 is depressed and apparently curved. Therefore, it is preferable that the distance S between the flat surfaces 132 of two adjacent protrusions of the plurality of protrusions 131 is 0.6 mm or more and 1.2 mm or less. Tolerance may be accepted 0.1 mm.

Although not shown in the drawing, the plurality of protrusions 131 may be formed in mixing a straight shape, a curved shape, a dotted shape, or the like, and may be formed in various shapes conforming to the standard.

Figure 9:
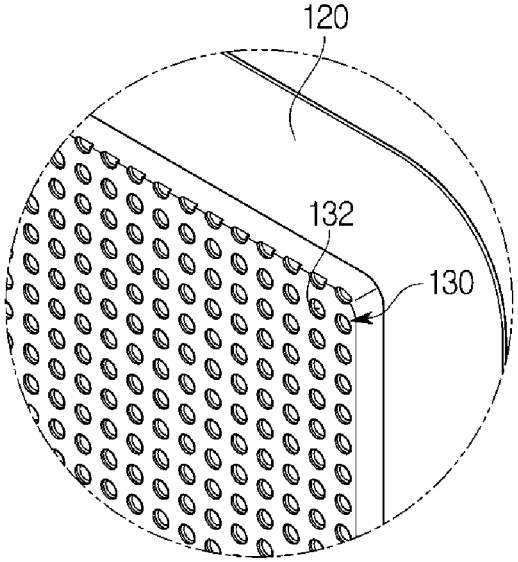
FIG. 9 is an enlarged perspective view of a part of a base of a control panel of an oven according to another embodiment of the present disclosure.
Figure 10:
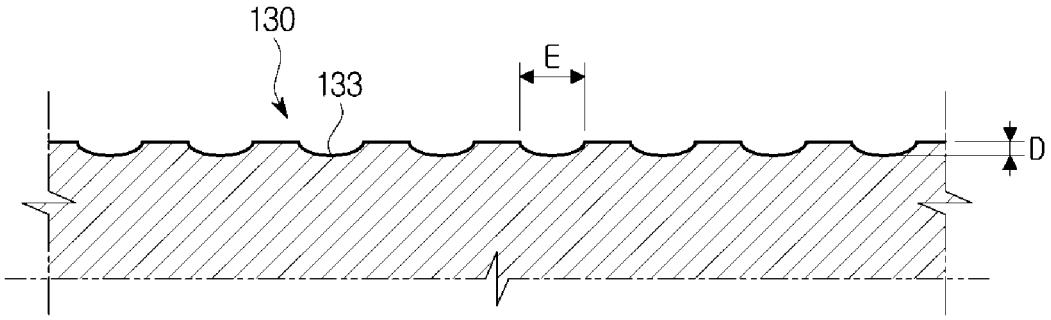
FIG. 10 is an enlarged cross-sectional view of a part of a base of a control panel of an oven according to another embodiment of the present disclosure.

FIG. 9 is an enlarged perspective view of a part of a base of a control panel of an oven according to another embodiment of the present disclosure, and FIG. 10 is an enlarged cross-sectional view of a part of a base of a control panel of an oven according to another embodiment of the present disclosure.

Referring to FIGS. 9 and 10, the control panel 100 of the oven 1 is provided with the plurality of recesses 133 provided in the adhering portion 130 of the base 120 to which the membrane panel 110 is attached so that the membrane panel 110 may be attached without generating any residual bubbles, without using any special equipment or tools.

The membrane panel 110 may be attached to the flat surface 132 of the base 120 where the recess 133 is not formed. The membrane panel 110 may include an adhesive layer (not shown) formed on the rear surface thereof with an adhesive tape or an adhesive. In addition, an adhesive layer may be provided on the adhering portion 130 of the base 120 to which the membrane panel 110 is attached. In particular, an adhesive layer may be provided on the flat surface 132 of the base 120 where the recess 133 is not formed.

The plurality of recesses 133 may be integrally formed with the base 120. The plurality of recesses 133 may be formed with the base 120 by pressing a plate material such as an iron plate. In addition, the base and the plurality of recesses 133 may be formed by injection molding a metal or a resin material. The recess 133 may be formed by corroding the portion of the base 120 except for the portion where the recess 133 is formed.

It is preferable that the sum of the areas of the flat surfaces 132 of the plurality of recesses 133 is equal to or less than 60% of the area of the adhering portion of the base 120 in order to secure a certain level of adhesion. However, it is preferable that the sum of the areas of the flat surfaces 132 of the plurality of recesses 133 is 30% or more of the area of the adhering portion of the base 120 in order to suppress the generation of the residual bubbles. More preferably, the sum of the areas of the flat surfaces 132 of the plurality of recesses 133 may be 40% of the area of the adhering portion of the base 120.

A depth D of the recess 133 provided on the base 120 may vary depending on the forming method, but it may be generally 0.06 mm or more. If the depth of the recess 133 is excessively deep, there is a possibility that water or foreign matter may permeate between the protrusions, that is, between the membrane panel 110 and the base 120. Therefore, the depth D of the recess 133 may be 0.09 mm or less. More preferably, the depth D of the recess 133 may be 0.08 mm. Tolerance may be accepted to 0.01 mm.

The depth of the recess 133 may be lowered below the lower limit value according to the development of the manufacturing technology, and may be increased to an upper limit value or more when a material not susceptible to humidity is used for the membrane panel 110.

In order to secure the flatness and adhesiveness of the base 120, the distance S between two adjacent recesses of the plurality of recesses 133 may be 10 times or more and 18 times or less than the depth D of the recess 133.

Referring to FIG. 9, the plurality of recesses 133 may be formed in a dotted shape. The plurality of recesses 133 formed in a dotted shape may be regularly arranged in a triangular array or a rectangular array. However, the spirit of the present invention is not limited thereto, and a plurality of recesses may be arranged to be irregularly distributed.

Although not shown in the drawings, the plurality of recesses formed in a linear shape may be arranged in parallel with each other, and may be arranged at regular intervals. However, the spirit of the present disclosure is not limited thereto, and a plurality of recesses may not be parallel to each other or may not be arranged with a constant interval.

When a diameter E of the dotted shaped recess 133 or the width of the linear shaped recess is too small, it is not easy to discharge the air between the membrane panel 110 and the base 120. When the diameter E of dotted shaped recess 133 or the width of the linear shaped recess is too large, there is a possibility that the membrane panel 110 is depressed and apparently curved. Therefore, it is preferable that the diameter E or the width of the recess is 0.6 mm or more and 1.2 mm or less. Tolerance may be accepted 0.1 mm.

The oven which is one embodiment of the home appliance has been shown and described above. However, the control panel according to the idea of the present disclosure may be applied to all products of all home appliances as well as cooking devices other than the oven 1.

The home appliance according to the present disclosure may prevent water from permeating through the rear surface of the membrane panel while preventing air bubbles from remaining on the back surface of the membrane panel.

It may improve the quality of appearance because the membrane panel is not bent by residual bubbles and the malfunction of the home appliance may be prevented since the circuit structure provided inside the membrane panel is not pressed by the residual bubbles.

The membrane panel may be attached to the adhesive surface so that residual bubbles are not generated even without using a separate device or tool, thereby ensuring a uniform attachment quality while simplifying the process.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. An apparatus including a control panel for controlling an operation of the apparatus, the control panel comprising:

a membrane panel; and a base having an adhering portion including a plurality of protrusions, each of the plurality of protrusions having a flat surface to which the membrane panel is adhered, thereby forming a channel for air between the base and the membrane panel to escape such that air bubbles are not formed in the membrane panel as the membrane panel is adhered to the base, wherein a total area of the flat surfaces of the plurality of protrusions is between 40% and 70% of a total area of the adhering portion of the base.

2. The apparatus of claim 1, wherein the membrane panel includes an adhesive layer on a surface of the membrane panel to be adhered to the base.

3. The apparatus of claim 1, wherein an adhesive layer is provided to be adhered to the flat surface.

4. The apparatus of claim 1, wherein the plurality of protrusions are integrally formed with the base, and the base and the plurality of protrusions are formed by pressing a plate material.

5. The apparatus of claim 1, wherein the plurality of protrusions are integrally formed with the base, and the base and the plurality of protrusions are formed by injection molding.

6. The apparatus of claim 1, wherein each of the plurality of protrusions protrudes from the base by between 0.06 mm and 0.09 mm.

7. The apparatus of claim 1, wherein each of the plurality of protrusions protrudes from the base by 0.08 mm.

8. The apparatus of claim 1, wherein a total area of the flat surfaces of the plurality of protrusions is 60% of a total area of the adhering portion of the base.

9. The apparatus of claim 1, wherein the plurality of protrusions include at least one of straight lined protrusions arranged in parallel to each other, curved lined protrusions arranged in parallel to each other, and dot shaped protrusions arranged at regular intervals to each other.

10. The apparatus of claim 9, wherein a width of the flat surface of each of the plurality of protrusions is between 10 times and 18 times a distance each of the plurality of protrusions protrudes from the base.

11. The apparatus of claim 1, wherein a distance between flat surfaces of adjacent protrusions among the plurality of protrusions is between 0.6 mm and 1.2 mm.

12. An apparatus including a control panel for controlling an operation of the apparatus, the control panel comprising:

a membrane panel; and a base having an adhering portion to which the membrane panel is adhered, the adhering portion including a plurality of recesses, thereby forming a channel for air between the base and the membrane panel to escape such that air bubbles are not formed in the membrane panel as the membrane panel is adhered to the base, wherein a total area where the recesses are formed is between 30% and 60% of a total area of the adhering portion of the base.

13. The apparatus of claim 12, wherein the base and the plurality of recesses are formed by at least one of pressing and etching a plate material.

14. The apparatus of claim 12, wherein the base and the plurality of recesses are formed by injection molding.

15. The apparatus of claim 12, wherein each of the plurality of recesses is recessed in the base to a depth of between 0.06 mm and 0.09 mm.

16. The apparatus of claim 12, wherein each of the plurality of recesses is formed in at least one of a straight, curved, and a dotted shape.

17. The apparatus of claim 12, wherein a distance between two adjacent recesses among the plurality of recesses is between 10 times and 18 times a depth of each of the two adjacent recesses.

18. The apparatus of claim 12, wherein a width of each of the plurality of recesses is between 0.6 mm and 1.2 mm.

* * * * *